US008651908B1

(12) United States Patent
Glodowski et al.

(10) Patent No.: US 8,651,908 B1
(45) **Date of Patent: *Feb. 18, 2014**

(54) ANTI-INGESTION SYSTEM FOR A MARINE DRIVE

(75) Inventors: Mark J. Glodowski, De Pere, WI (US); Matthew W. Jaeger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 149 days.

This patent is subject to a terminal disclaimer.

(21) Appl. No.: 13/355,632

(22) Filed: Jan. 23, 2012

Related U.S. Application Data

(63) Continuation-in-part of application No. 12/897,129, filed on Oct. 4, 2010, now Pat. No. 8,317,557.

(51) Int. Cl.
*B63H 21/38* (2006.01)

(52) U.S. Cl.
USPC ..... 440/89 R; 60/324

(58) Field of Classification Search
USPC .... 440/88 A, 88 J, 89 A, 89 C, 89 R; 60/310, 60/321, 322, 323, 324
See application file for complete search history.

(56) References Cited

U.S. PATENT DOCUMENTS

| | | | | |
|---|---|---|---|---|
| 4,178,873 | A | 12/1979 | Bankstahl | |
| 4,346,729 | A * | 8/1982 | Franz | 137/353 |
| 4,498,876 | A | 2/1985 | Zemlicka | |
| 4,526,002 | A | 7/1985 | Bibow | |
| 4,831,822 | A | 5/1989 | Yoshimura | |
| 6,077,137 | A | 6/2000 | Hahn | |
| 6,500,038 | B1 | 12/2002 | Jaeger et al. | |
| 6,571,753 | B1 | 6/2003 | Jaeger | |
| 6,638,124 | B2 | 10/2003 | Zoubul et al. | |
| 8,317,557 | B2 * | 11/2012 | Dudarenke et al. | 440/89 R |

* cited by examiner

*Primary Examiner* — Lars A Olson
(74) *Attorney, Agent, or Firm* — Andrus Intellectual Property Law, LLP

(57) ABSTRACT

An anti-ingestion system is provided for a marine drive with a submerged exhaust outlet. An anti-ingestion valve is operated by differential pressure thereacross to a closed condition when the engine is operating in an on state and cooling water is being pumped through a water conduit to an exhaust mixing point, with the anti-ingestion valve blocking passage of cooling water therepast in the noted closed condition. The anti-ingestion valve is operated by differential pressure thereacross to an open condition when the engine is in an off state, and permits passage of air therethrough and communicates atmospheric pressure through the water conduit to the exhaust mixing point to relieve vacuum in the exhaust system.

16 Claims, 12 Drawing Sheets

ANTI-INGESTION SYSTEM FOR A MARINE DRIVE

CROSS REFERENCE TO RELATED APPLICATION

The present application is a continuation-in-part of co-pending U.S. patent application Ser. No. 12/897,129, filed Oct. 4, 2010, which is incorporated herein by reference.

BACKGROUND AND SUMMARY

The invention relates to marine drives with submerged exhaust outlets, and more particularly to anti-ingestion systems for preventing ingestion of water into the marine drive internal combustion engine after turn-off.

Various types of marine drives have an internal combustion engine having an exhaust system, and a cooling system drawing cooling water from the body of water in which the marine drive is operating. The exhaust system may discharge engine exhaust through the drive and through the propeller. After turn-off of the engine, and upon cool down of the exhaust gas that is trapped between the engine combustion chamber and the submerged exhaust outlet through the propeller, e.g. 10 to 20 minutes, a vacuum may be created in the exhaust system which may draw water back into the engine, which is deleterious to the engine. This water may cause hydrolock upon attempted re-start of the engine, or cause corrosion on an exhaust valve, leading to engine durability issues, or damage emissions compliance hardware.

The present invention arose during continuing development efforts in the above technology.

DETAILED DESCRIPTION

Figure 1:
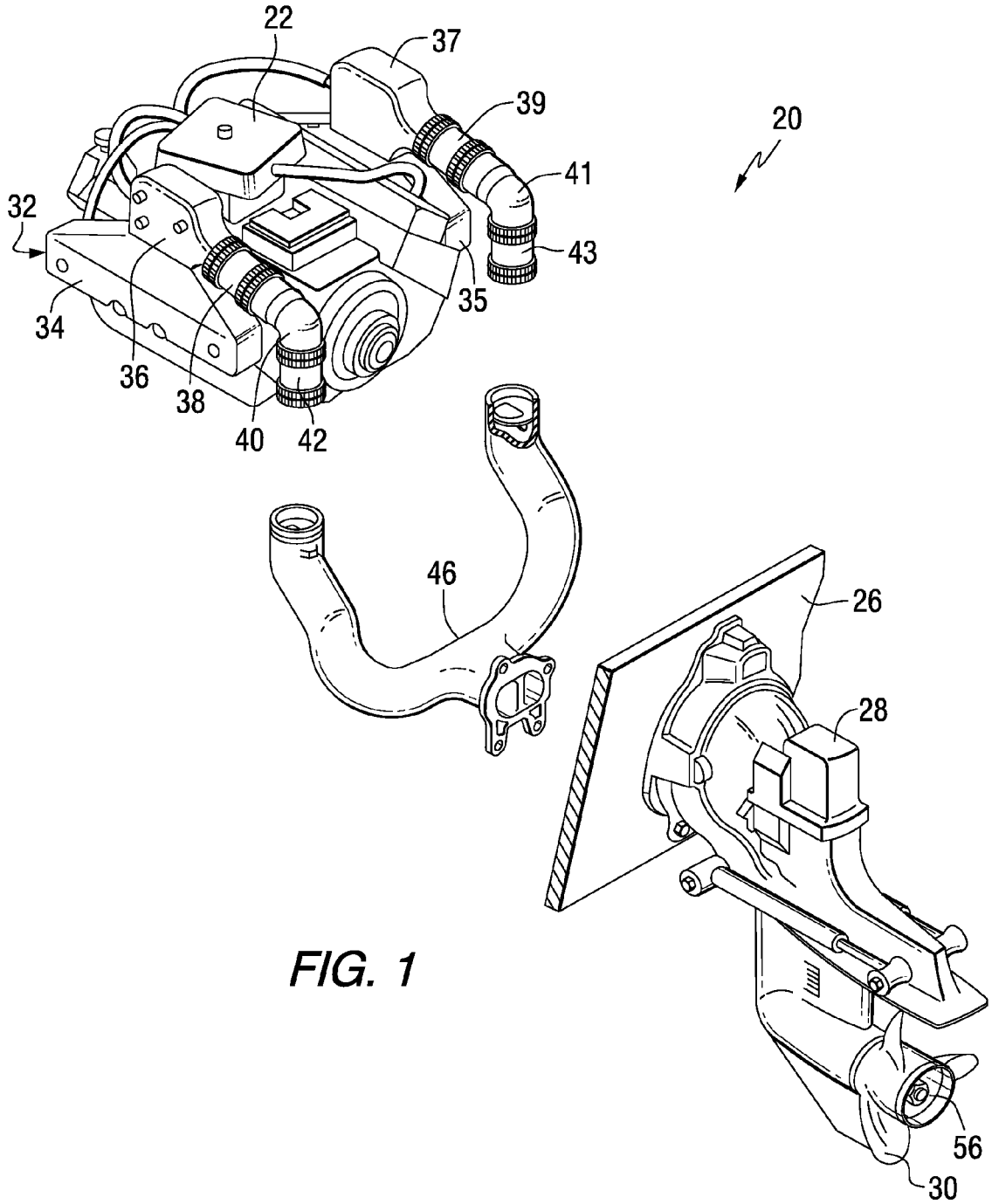
FIG. 1 is a perspective exploded view of a sterndrive marine drive, and is taken from U.S. Pat. No. 4,498,876, incorporated herein by reference.
Figure 2:
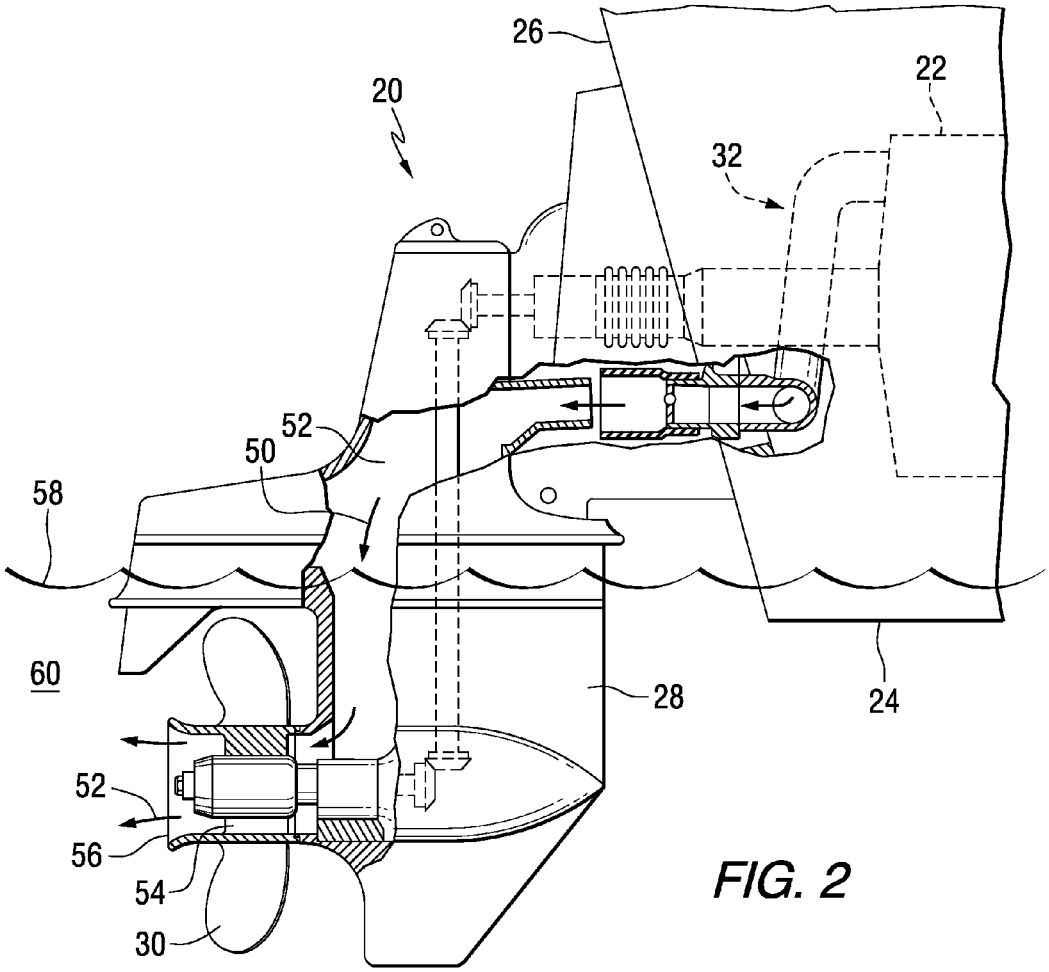
FIG. 2 is a fragmentary side elevation view of a sterndrive with parts broken away, and is taken from U.S. Pat. No. 4,178,873, incorporated herein by reference.

FIGS. 1 and 2 show a marine drive 20, in one embodiment a sterndrive having an inboard internal combustion engine 22 in a vessel 24 having a transom 26 and operatively connected in torque transmitting relation with an outdrive 28 driving a propeller 30 to propel the vessel. The engine has an exhaust system 32 including port and starboard exhaust manifolds 34 and 35, port and starboard exhaust elbows 36 and 37 connected by respective flexible exhaust bellows 38 and 39 and respective turned connector pipes 40 and 41 and respective flexible exhaust bellows 42 and 43 to U-shaped or Y-shaped exhaust pipe 46 connected through transom 26 to outdrive 28 for passage therethrough as shown at arrows 50 in exhaust passage 52 for discharge through propeller hub exhaust passage 54 at submerged exhaust outlet 56, all as is conventional. The exhaust system discharges exhaust at exhaust outlet 56 below the surface 58 of a body of water 60 in which the vessel 24 and marine drive 20 are operating.

Figure 3:
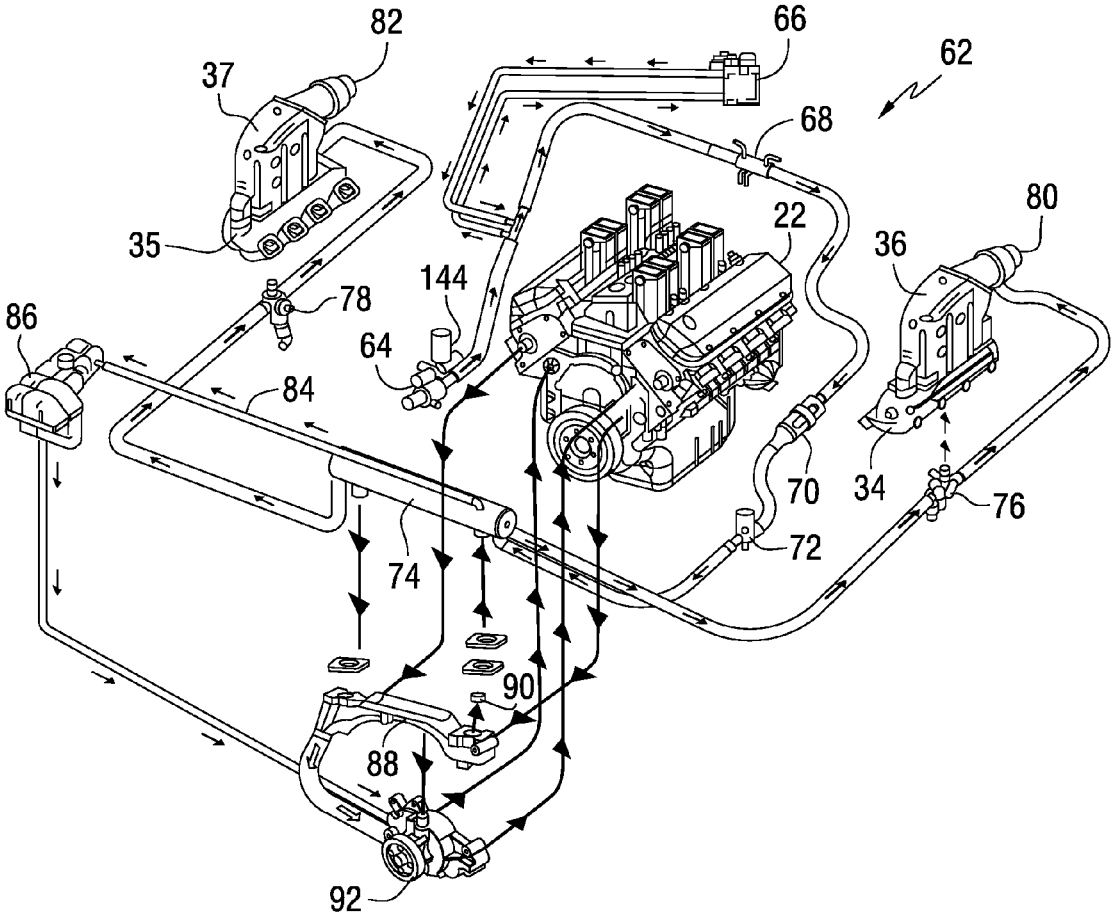
FIG. 3 is a schematic drawing of a marine drive cooling system.

The marine drive has a cooling system 62, FIG. 3, having a seawater pump 64 drawing cooling water from the body of water 60 in which the marine drive is operating and pumping, the cooling water through a fuel supply cooler 66, a power steering cooler 68, an oil cooler 70, a drain valve 72, an engine heat exchanger 74, and then through pressure relief valves 76 and 78 to respective port and starboard exhaust manifolds 34 and 35 having respective port and starboard exhaust elbows 36 and 37, which cooling water then is discharged into and mixes with exhaust from the respective exhaust elbow outlets 80 and 82 and then is returned to the body of water 60 with the exhaust through outdrive exhaust passage 52 and propeller hub exhaust passage 54 to submerged exhaust outlet 56, as is conventional. Engine heat exchanger 74 transfers heat from and cools ethylene glycol coolant flowing in closed cooling system 84 of the engine, which includes coolant reservoir 86, cross-over coolant conduit 88, thermostat 90, and circulating pump 92, as is conventional.

Figure 4:
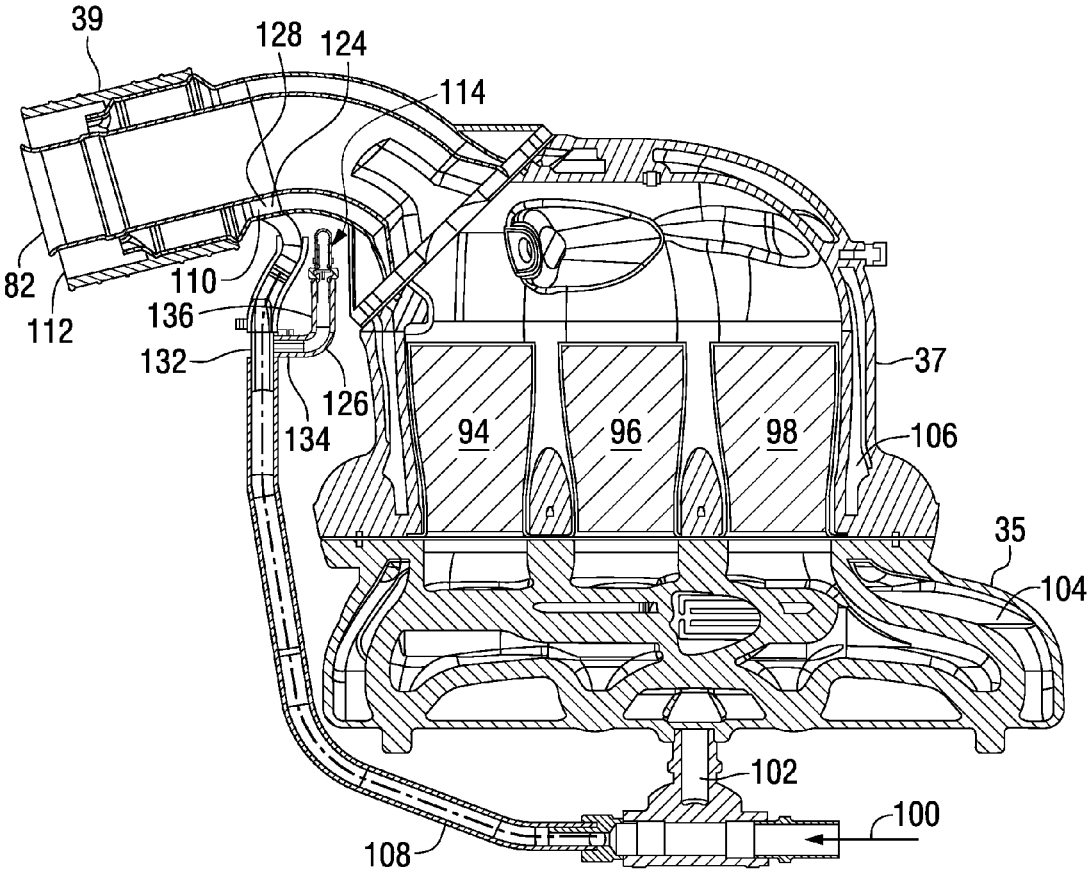
FIG. 4 is an enlarged sectional view of a component of FIG. 3.
Figure 5:
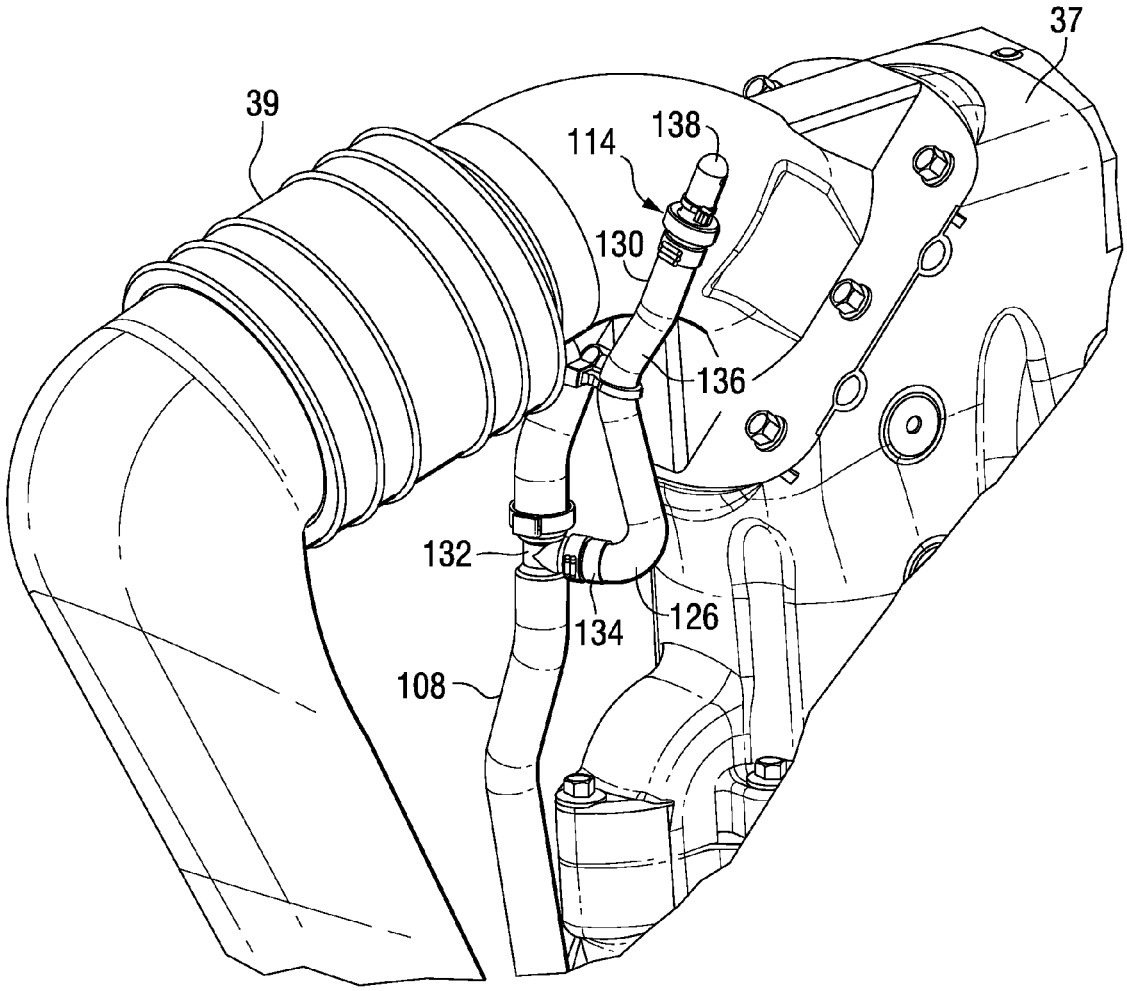
FIG. 5 is a perspective view of a portion of the assembly of FIG. 4.
Figure 6:
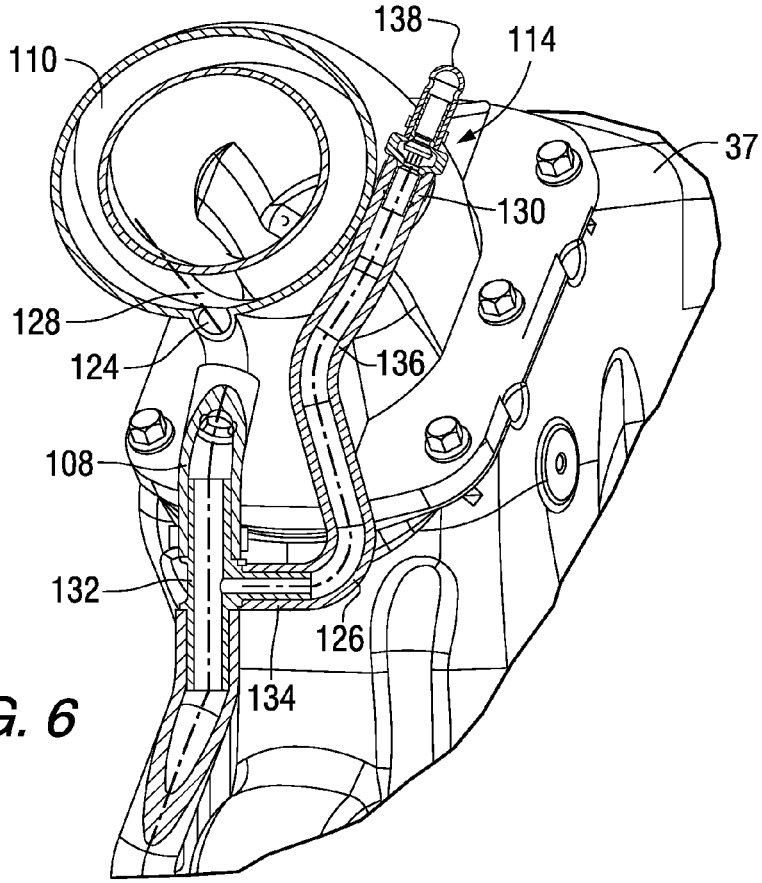
FIG. 6 is a perspective view from a different angle of a portion of the assembly of FIG. 5 partially cutaway.
Figure 7:
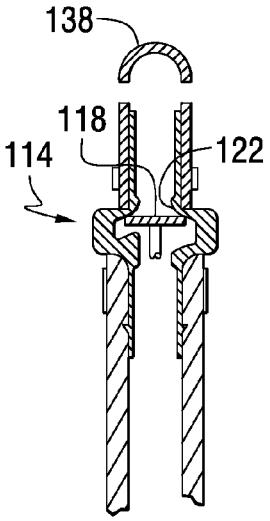
FIG. 7 is an enlarged sectional view of a portion of the assembly of FIG. 6.

FIGS. 4-6 show exhaust manifold 35 and exhaust elbow 37, with the other exhaust manifold 34 and exhaust elbow 36 being the same. The assembly includes catalytic elements such as 94, 96, 98 for treating the exhaust passing upwardly therethrough and then turning at the top of the elbow and passing leftwardly in FIG. 4 to the exhaust elbow outlet at 82. The cooling water flows as shown at arrow 100 and passage 102 into exhaust manifold 35 and its cooling jacket 104 and then to exhaust elbow 37 and its cooling jacket 106, as is conventional. The cooling water also flows through a bypass water conduit 108 to cooling jacket 110 to discharge into and mix with exhaust from the exhaust system at exhaust mixing point 112 at outlet 82 of the exhaust elbow 37. An anti-ingestion valve 114, FIGS. 5-8, is connected in communication with water conduit 108 and is operated by differential pressure across the valve to a closed condition, FIG. 7, when the engine is operating in an on state and cooling water is being pumped by pump 64 through water conduit 108 to exhaust mixing point 112. The anti-ingestion valve in the closed condition blocks passage of cooling water therepast. The anti-ingestion valve is operated by differential pressure thereacross to an open condition, FIG. 8, when the engine is in an off state and cooling water is not being pumped through water conduit 108 to exhaust mixing point 112. Actuation of the anti-ingestion valve 114 to the open condition occurs after engine turn-off and upon cool down of the exhaust gas (e.g. 10 to 20 minutes) that is trapped between the engine combustion chamber and the submerged exhaust outlet 56, which cool down creates a vacuum in the exhaust system, which vacuum provides the differential pressure which actuates anti-ingestion valve 114 to the noted open condition, FIG. 8. Anti-ingestion valve 114 in the noted open condition permits passage of air therethrough as shown at arrow 116, FIG. 8, to communicate atmospheric pressure through water conduit 108 to relieve vacuum in the exhaust system.

Figure 8:
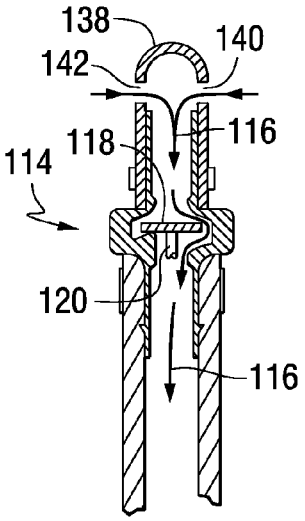
FIG. 8 is like FIG. 7 and shows a different operational condition.
Figure 9:
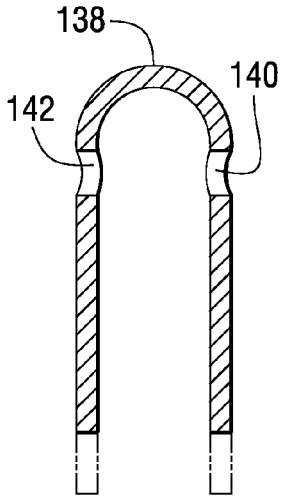
FIG. 9 is an enlarged view of a portion of the assembly of FIG. 7.

In one embodiment, anti-ingestion valve 114 is a diaphragm check valve, though other types of check valves may be used, for example a ball check valve and the like. FIG. 8 shows a diaphragm 118 in an open condition, with atmospheric passing as shown at arrow 116 around diaphragm 118 and through radially aligned slots or apertures in the lower valve seat and guide legs such as 120 extending downwardly from the diaphragm. In the closed condition of the valve, diaphragm 118 moves upwardly to seat against valve seat 122 in sealing relation, to block the flow of atmospheric air downwardly therepast, and also to block the flow of cooling water upwardly therepast. Movable valve member 118 moves in a first direction, namely upwardly, to the noted closed condition, FIG. 7, and moves in a second opposite direction, namely downwardly, to the open condition, FIG. 8. Valve member 118 moves in each of the noted first and second, namely upward and downward, directions in response to differential pressure and without a biasing spring. The anti-ingestion valve is actuated to the open condition, FIG. 8, after turn-off of the engine and upon cool down of the exhaust gas as noted above, creating a vacuum, and remains in the open condition of FIG. 8 until the next turn-on of the engine.

Anti-ingestion valve 114 is located along water conduit 108, FIGS. 4-6, in sufficiently close proximity to the exhaust mixing point 112 to quickly communicate vacuum in the exhaust system to the anti-ingestion valve. Water conduit 108 is connected at a connection point 124, FIGS. 4, 6, to exhaust elbow water jacket 110 to flow to exhaust mixing point 112, and anti-ingestion valve 114 is located within 100±50 mm (millimeters) of connection point 124. In one embodiment, the anti-ingestion valve is operated between the noted open and closed conditions in response to 75±25 mm water column pressure. The anti-ingestion valve is located along water conduit 108 in sufficiently close proximity to the exhaust mixing point to minimize the amount of water which must be evacuated when the anti-ingestion valve changes from the closed condition to the open condition to in turn provide rapid communication of atmospheric air pressure through the open anti-ingestion valve to the exhaust system at the exhaust mixing point, to relieve vacuum in the exhaust system. Anti-ingestion valve 114 is in a side branch conduit 126, FIG. 5, extending from water conduit 108. Exhaust elbow water jacket 110 has a lower segment 128, FIGS. 4, 6, passing the cooling water therethrough from water conduit 108 to mixing point 112. Side branch conduit 126 at anti-ingestion valve 114 extends at extension section 130 gravitationally above lower segment 128 of exhaust elbow water jacket 110. Anti-ingestion valve 114 is at a higher gravitational height than lower segment 128 of exhaust elbow water jacket 110. This is desirable in the event nuisance water leaks past diaphragm 118 when the engine is off, due to a few inches of water head above the valve adjacent the water jacket, which head pressure may be insufficient to consistently seal the diaphragm, hence allowing a possible leak. Raising the gravitational height of valve 114 above that of lower segment 128 of the exhaust elbow water jacket eliminates this possible leak.

In one embodiment, anti-ingestion valve 114 is connected to water conduit 108 at a Tee fitting 132, FIGS. 5, 6. In one embodiment, the noted side branch conduit 126 is a J-conduit having a lower hook leg 134 connected to water conduit 108 at Tee-fitting 132, and having an upper leg 136 extending upwardly from lower hook leg 134. Anti-ingestion valve 114 is located at upper leg 136. Movable valve member 118 moves up and down at upper leg 136 along the noted extension section 130. In one embodiment, extension section 130 above valve 114 is capped by a dust cap cover 138, FIGS. 5-9, having a pair of distally opposite ports or apertures 140 and 142 admitting atmospheric air thereinto as shown at arrows 116 in the open condition of the valve, FIG. 8. The dust cap prevents dust and debris from contaminating the valve diaphragm 118 which may be sensitive to small particles on the sealing surface against upper valve seat 122.

As is conventional, the cooling system may include a drain valve such as 144, FIG. 3, at the seawater pump 64. The drain valve has an open state draining the cooling system of cooling water when the engine is off including when the vessel is on the water and exhaust outlet 56, FIG. 2, is below the surface 58 of the body of water 60. Anti-ingestion valve 114 is in the noted open condition, FIG. 8, when drain valve 144 is in its open state, whereby to relieve possible vacuum in the cooling system and facilitate draining of cooling water therefrom.

FIGS. 10-15 disclose additional examples of anti-ingestion systems. The same numbers are used throughout these drawing figures to reference like features and components from drawing FIGS. 1-9.

Figure 10:
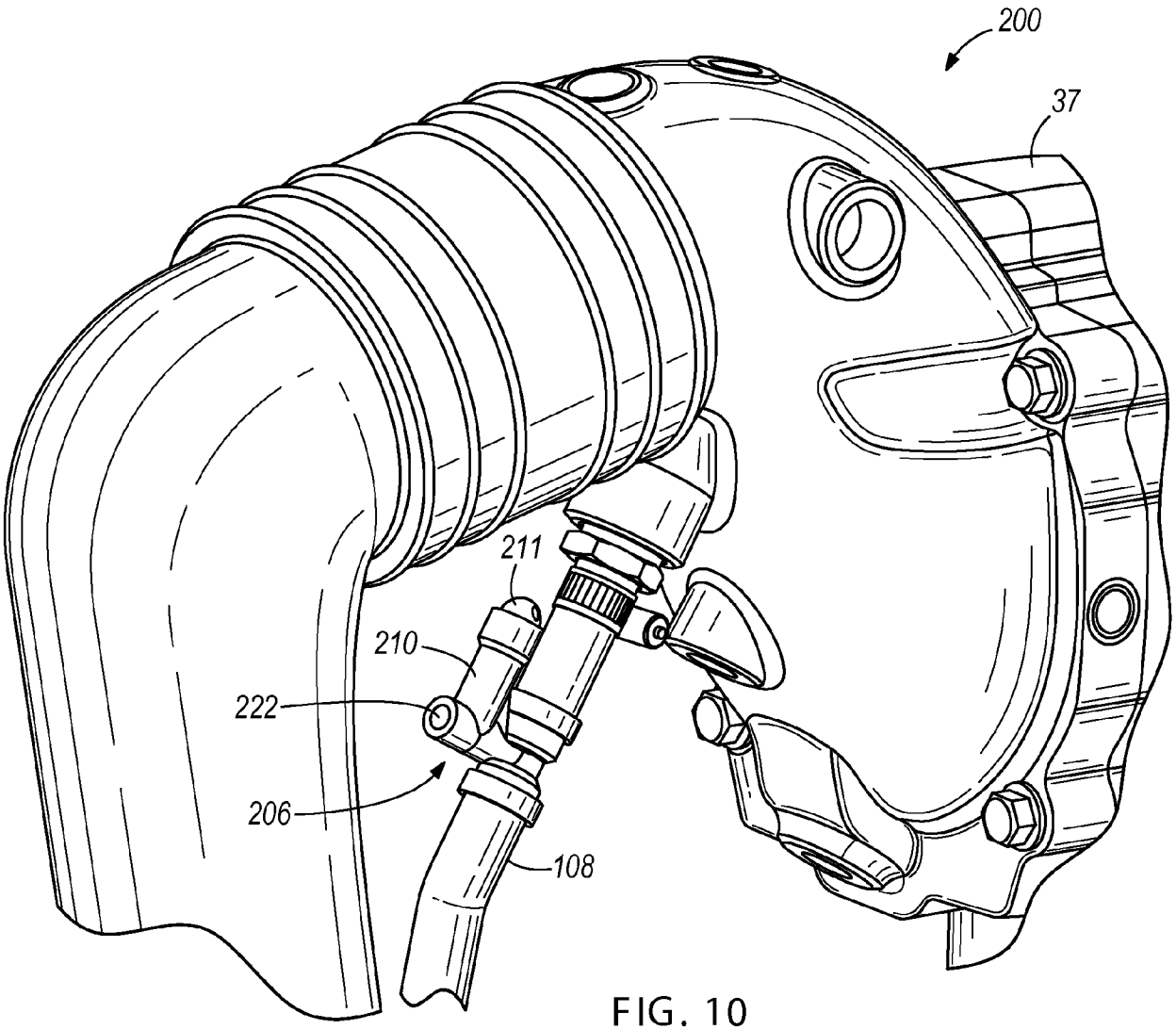
FIG. 10 is a view like FIG. 5 of another example of the assembly.
Figure 11:
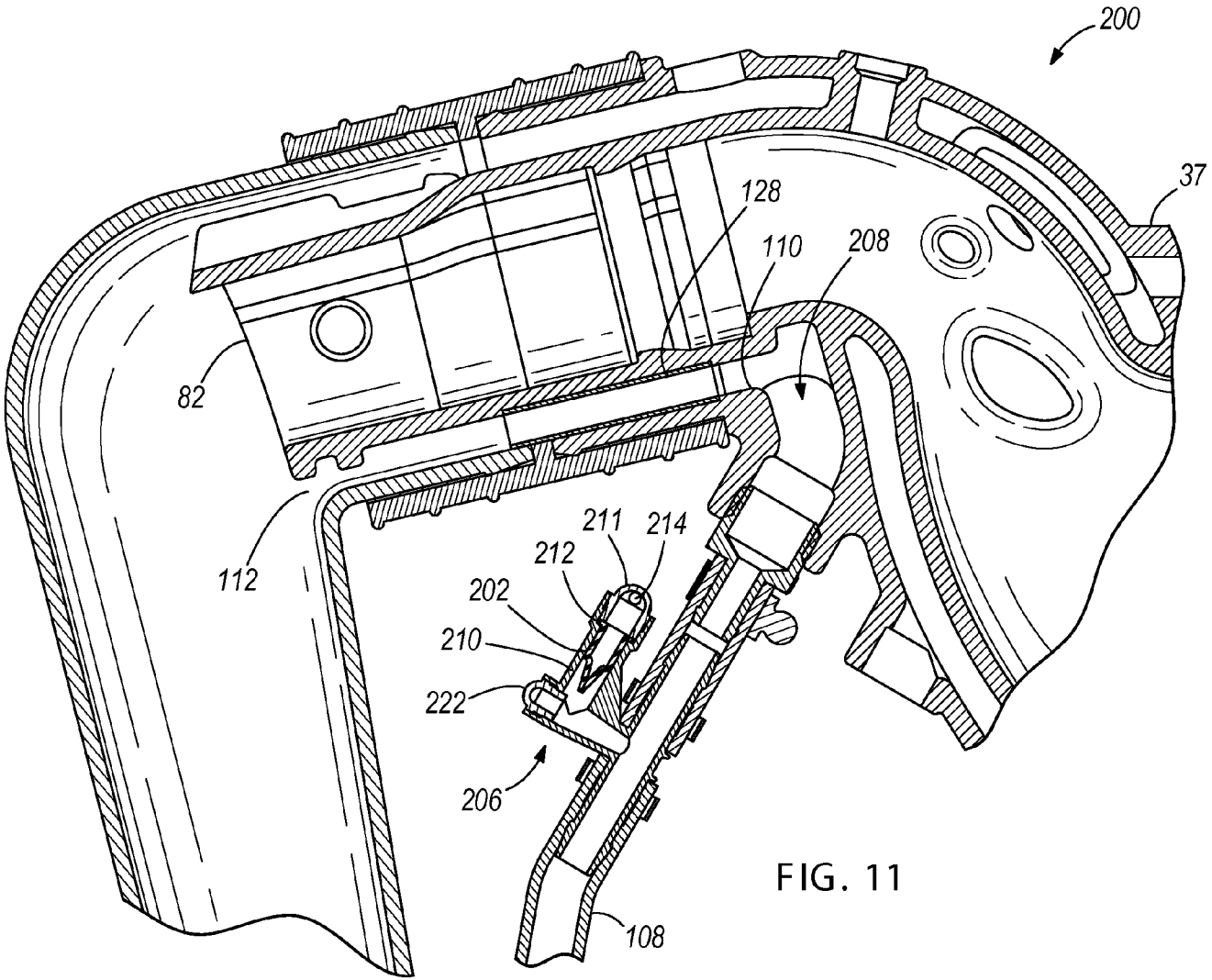
FIG. 11 is a sectional view of the portion of the assembly of FIG. 10.
Figure 12:
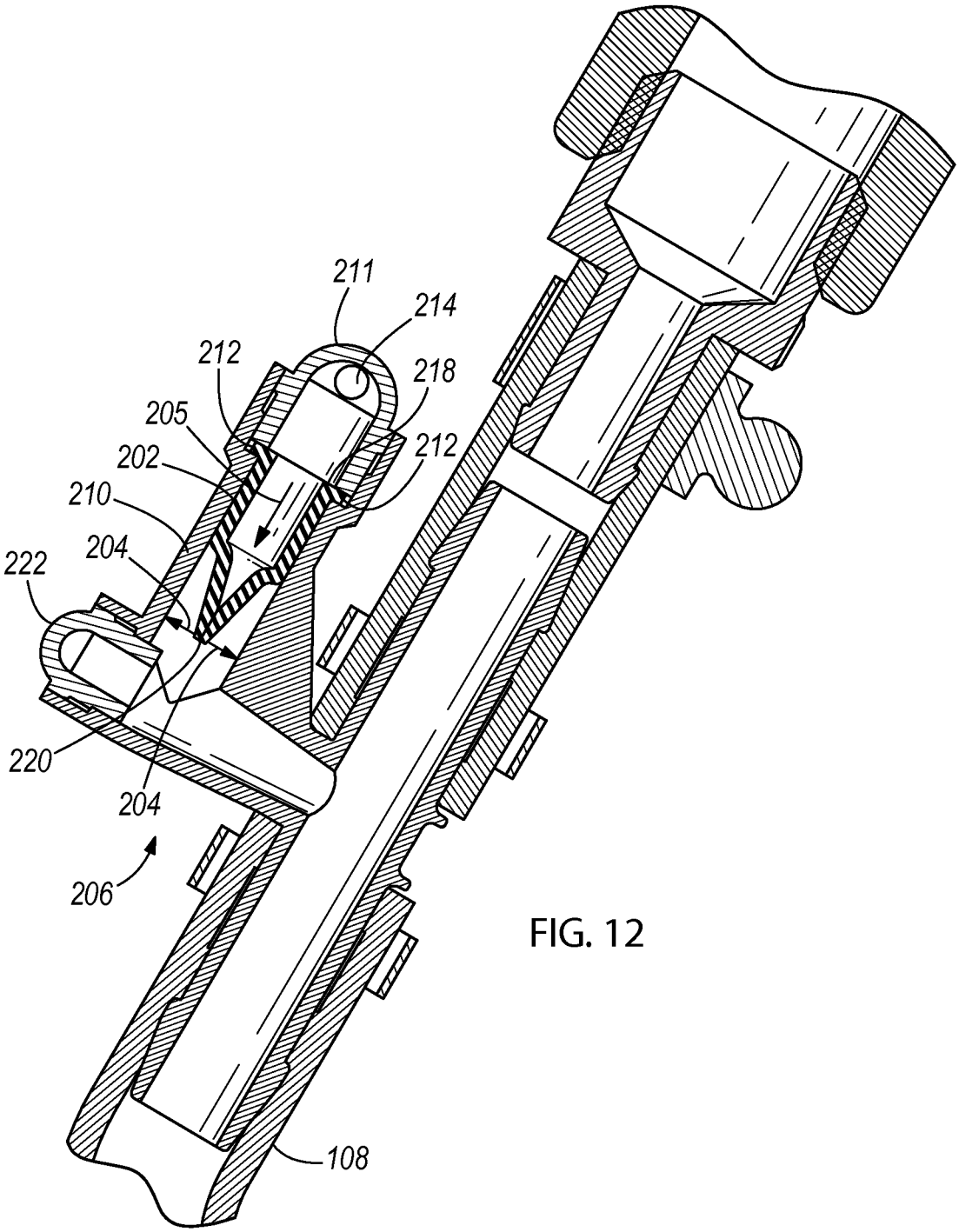
FIG. 12 is an enlarged sectional view of a portion of the assembly of FIG. 10.

FIGS. 10-12 depict another embodiment of an anti-ingestion system 200 for a marine drive 20 having an internal combustion engine 22. As with the embodiments described above, the system 200 includes the noted exhaust system 32 discharging exhaust at the exhaust outlet 56 below the noted surface of the body of water in which the marine drive 20 is operating. A cooling system 62 draws cooling water from the body of water and pumps the cooling water through a water conduit 108 to an exhaust mixing point 112 at outlet 82 of the exhaust elbow 37 to discharge into and mix with exhaust from the exhaust system 32.

A duckbill valve 202, FIGS. 11 and 12, is operated by differential pressure to a closed condition shown in the figures when the engine 22 is operating in an on state and the cooling water is being pumped through the water conduit 108 to the noted exhaust mixing point 112. In the closed position, the duckbill valve 202 blocks passage of cooling water therepast. When the engine 22 is in an off state and the cooling water is not being pumped through the water conduit 108 to the exhaust mixing point 112, the duckbill valve 202 is operated by differential pressure to an open condition, as shown at arrows 204, FIG. 12, thus permitting passage of air therethrough, as shown at arrow 205, and thus communication of atmospheric pressure to the exhaust mixing point 112 relieves vacuum in the exhaust system 32, as described herein above.

In FIGS. 10-12, the duckbill valve 202 is connected in communication with the water conduit 108 and the duckbill valve 202 in the open condition permits communication of atmospheric pressure to the exhaust mixing point 112 to relieve vacuum in the exhaust system 32. A T-fitting 206 connects the duckbill valve 202 with the water conduit 108. The I-fitting 206 and duckbill valve 202 are located along the water conduit 108 in sufficiently close proximity to the exhaust mixing point 112 to communicate vacuum in the exhaust system 32 to the duckbill valve 202. The duckbill valve 202 is also located along the water conduit 108 in sufficiently close proximity to the exhaust mixing point 112 to minimize the amount of water which must be evacuated when the duckbill valve 202 changes from the closed position to the open position, to in turn provide rapid communication of atmospheric air pressure through the duckbill valve 202 to the exhaust system 32 at the exhaust mixing point 112.

The water conduit 108 is connected at a connection point 208 to the exhaust elbow water jacket 110 to flow to the exhaust mixing point 112. The duckbill valve 202 is located in a side branch conduit 210 extending from the water conduit 108 and formed by the T fitting 206. The exhaust elbow water jacket 110 has a lower segment 128 passing the cooling water therethrough from the water conduit 108. The duckbill valve 202 is normally closed due to its resiliency, and is actuated into the open condition under sufficient differential pressure after turnoff of the engine 32. The valve 202 remains in the open condition until the differential pressure decreases to a point where the resiliency of the valve 202 returns the valve 202 to the closed condition.

As in the embodiments described herein above with reference to FIGS. 1-9, the cooling system 62 has a drain valve 72 having an open state draining the cooling system 62 of cooling water including when the exhaust outlet 56 is below the surface of the body of water. The duckbill valve 202 is in the open condition when the drain valve 72 is in the open state, to relieve possible vacuum in the cooling system 32 and facilitate the draining of the cooling water therefrom. Thus, the duckbill valve 202 communicates atmospheric pressure to the cooling system 32 when the cooling system 32 is drained of cooling water.

A cap 211 is disposed on the duckbill valve 202 and sealed against a flange 212 extending from the duckbill valve 202. The cap 211 has opposing apertures 214 admitting air into the duckbill valve 202. A screen (not shown) can be disposed on the first end 218 of the duckbill valve 202 for filtering airflow through the duckbill valve 202 to the water conduit 108. Optionally, another screen (not shown) can be placed on the second end 220 of the duckbill valve 202, filtering cooling water to keep debris out of the duckbill valve 202. A core plug 222 can be provided at the second end 220 of the duckbill valve 202 and optionally can facilitate checking and cleaning of the second end 220 of the duckbill valve 202.

Figure 13:
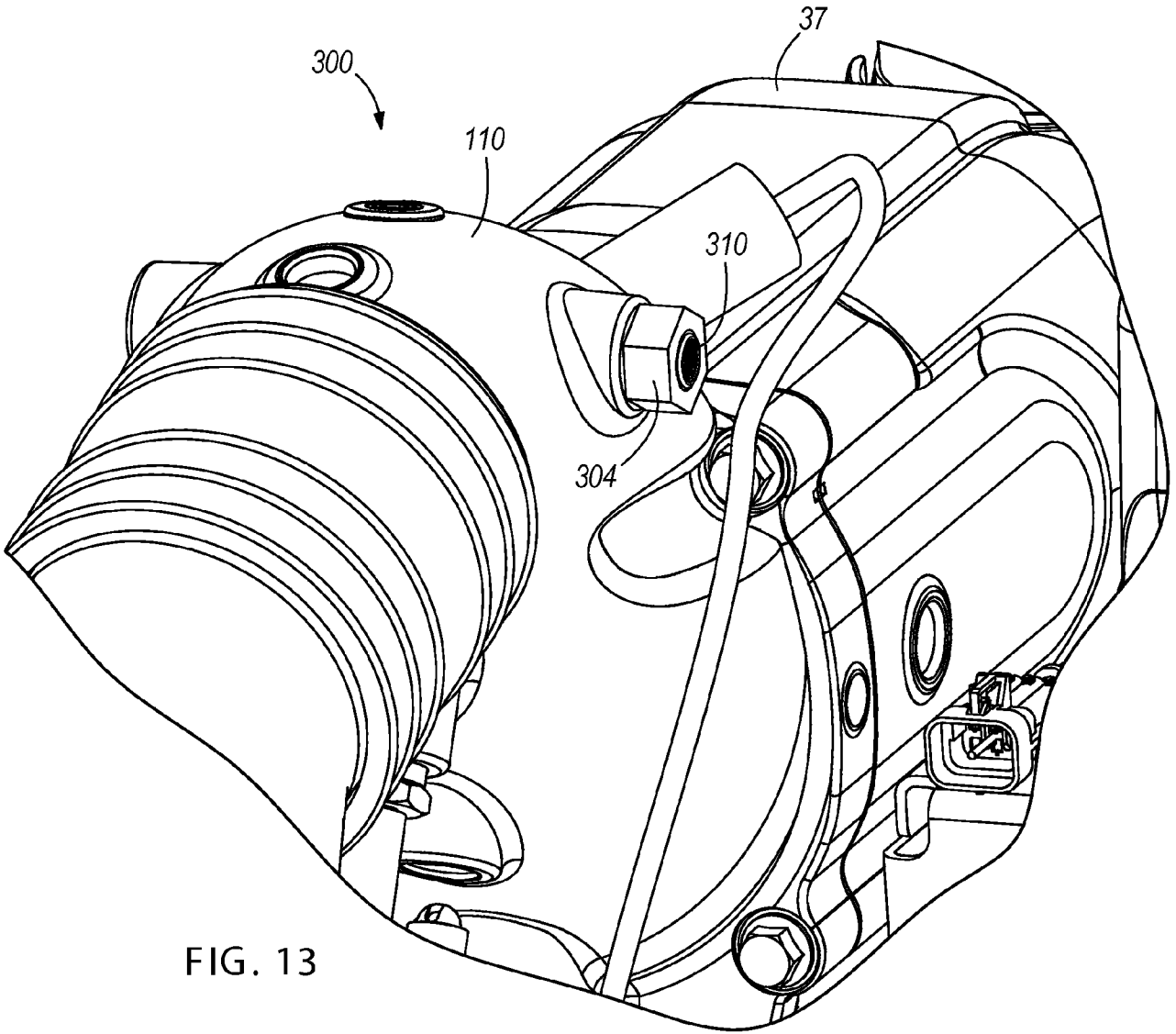
FIG. 13 is like FIG. 5 showing another example of the assembly.
Figure 14:
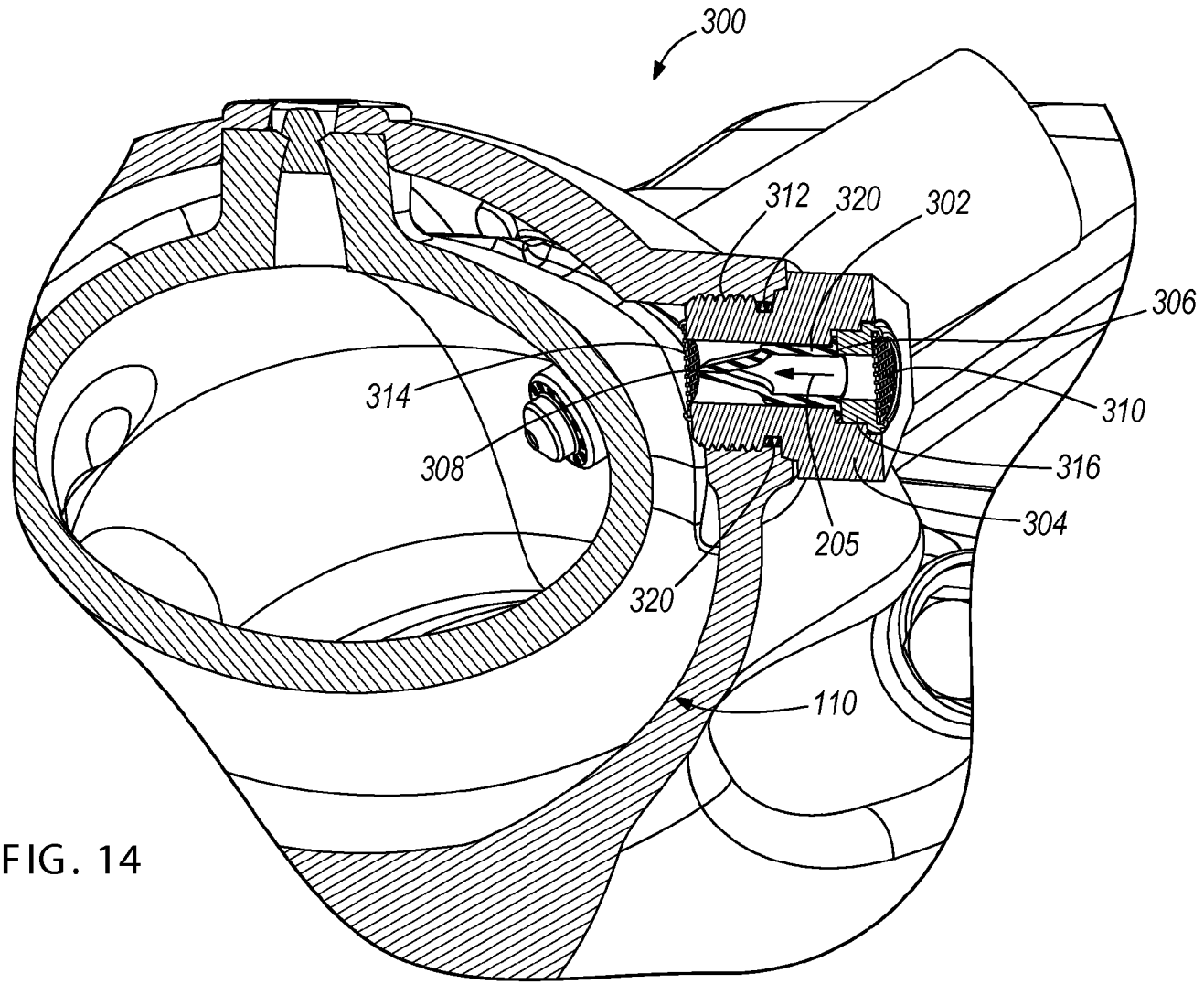
FIG. 14 is a sectional view of the assembly of FIG. 13.
Figure 15:
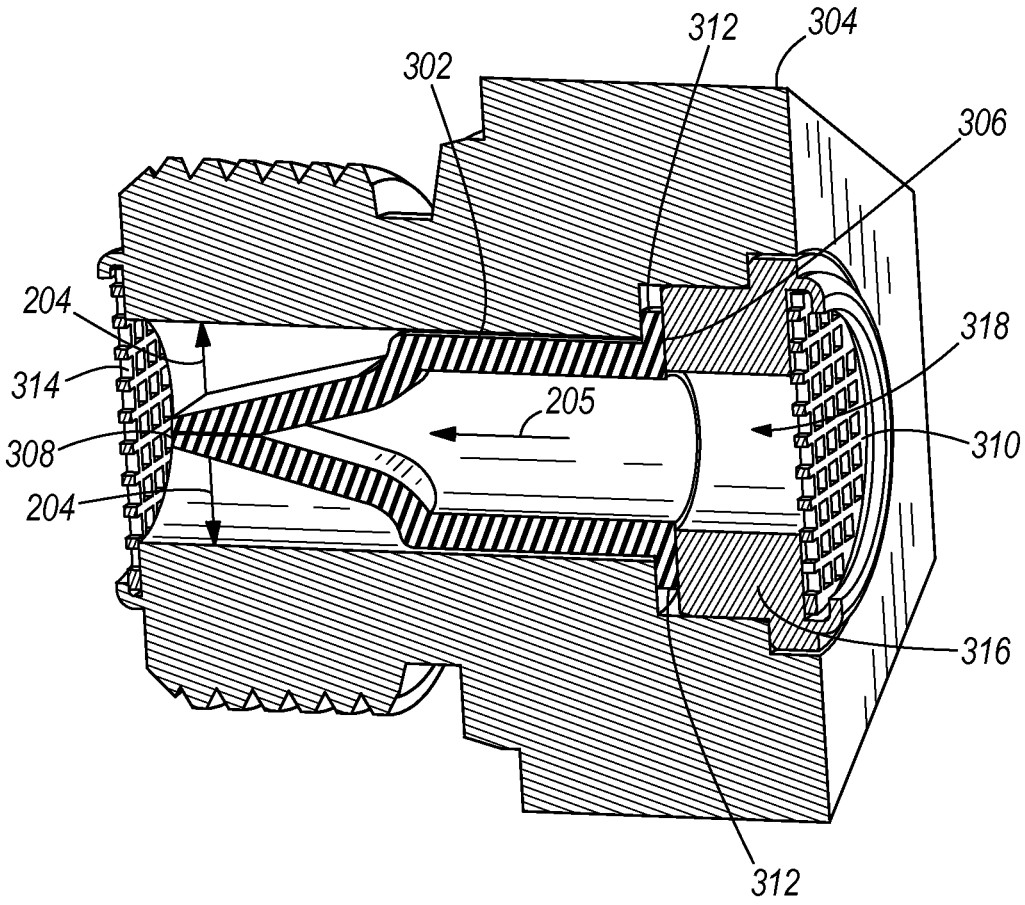
FIG. 15 is an enlarged sectional view of a portion of the assembly of FIG. 14.

FIGS. 13-15 depict another embodiment of an anti-injection system 300. In this example, the duckbill water valve 302 is directly connected to the exhaust elbow water jacket 110 by a fitting 304. The duckbill valve 302 has a first end 306 exposed to atmosphere and a second end 308 exposed to the exhaust elbow water jacket 110. A screen 310 is provided on the first end 306 for filtering airflow through the duckbill valve 302 to the exhaust elbow water jacket 110. Optionally, another screen 314 can be provided on the second end 308 filtering cooling water to keep debris out of the duckbill valve 202.

The fitting 304 is connected to the exhaust elbow 37 by a threaded connection 312. A base 316 on the screen 310 can provide a seal against a flange 312 extending from the duckbill valve 302. The base 316 has an aperture 318 facilitating flow of air therethrough. A seal 320 seals the fitting 304 to the exhaust elbow water jacket and prevents flow of air through the noted threaded connection 312. Other mechanical sealing structures can be employed.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. An anti-ingestion system for a marine drive having an internal combustion engine, the system comprising:

an exhaust system discharging exhaust at an exhaust outlet below the surface of a body of water in which the marine drive is operating;

a cooling system drawing cooling water from the body of water and pumping the cooling water through a water conduit to an exhaust mixing point to discharge into and mix with exhaust from the exhaust system; and a duckbill valve being operated by differential pressure thereacross to a closed condition when the engine is operating in an on state and the cooling water is being pumped through the water conduit to the exhaust mixing point, the duckbill valve in the closed condition blocking passage of cooling water therepast, the duckbill valve being operated by differential pressure thereacross to an open condition when the engine is in an off state and the cooling water is not being pumped through the water conduit to the exhaust mixing point, the duckbill valve in the open condition permitting passage of air therethrough and communication of atmospheric pressure to the exhaust mixing point to relieve vacuum in the exhaust system;

wherein the duckbill valve is connected in communication with the water conduit and the duckbill valve in the open condition permits communication of atmospheric pressure to the exhaust mixing point to relieve vacuum in the exhaust system; and a Tee fitting connecting the duckbill valve with the water conduit.

2. An anti-ingestion system for a marine drive having an internal combustion engine, the system comprising:

an exhaust system discharging exhaust at an exhaust outlet below the surface of a body of water in which the marine drive is operating;

a cooling system drawing cooling water from the body of water and pumping the cooling water through a water conduit to an exhaust mixing point to discharge into and mix with exhaust from the exhaust system; and a duckbill valve being operated by differential pressure thereacross to a closed condition when the engine is operating in an on state and the cooling water is being pumped through the water conduit to the exhaust mixing point, the duckbill valve in the closed condition blocking passage of cooling water therepast, the duckbill valve being operated by differential pressure thereacross to an open condition when the engine is in an off state and the cooling water is not being pumped through the water conduit to the exhaust mixing point, the duckbill valve in the open condition emitting passage of air therethrough and communication of atmospheric pressure to the exhaust mixing point to relieve vacuum in the exhaust system;

wherein the duckbill valve is connected in communication with the water conduit and the duckbill valve in the open condition permits communication of atmospheric pressure to the exhaust mixing point to relieve vacuum in the exhaust system; and wherein the duckbill valve is located along the water conduit in sufficiently close proximity to the exhaust mixing point to communicate vacuum in the exhaust system to the duckbill valve.

3. An anti-ingestion system for a marine drive having an internal combustion engine, the system comprising:

an exhaust system discharging exhaust at an exhaust outlet below the surface of a body of water in which the marine drive is operating;

a cooling system drawing cooling water from the body of water and pumping the cooling water through a water conduit to an exhaust mixing point to discharge into and mix with exhaust from the exhaust system; and a duckbill valve being operated by differential pressure thereacross to a closed condition when the engine is operating in an on state and the cooling water is being pumped through the water conduit to the exhaust mixing point, the duckbill valve in the closed condition blocking passage of cooling water therepast, the duckbill valve being operated by differential pressure thereacross to an open condition when the engine is in an off state and the cooling water is not being pumped through the water conduit to the exhaust mixing point, the duckbill valve in the open condition permitting passage of air therethrough and communication of atmospheric pressure to the exhaust mixing point to relieve vacuum in the exhaust system;

wherein the duckbill valve is connected in communication with the water conduit and the duckbill valve in the open condition permits communication of atmospheric pressure to the exhaust mixing point to relieve vacuum in the exhaust system; and wherein the duckbill valve is located along the water conduit in sufficiently close proximity to the exhaust mixing point to minimize the amount of water which must be evacuated when the duckbill valve changes from the closed position to the open position to in turn provide rapid communication of atmospheric air pressure through the duckbill valve to the exhaust system at the exhaust mixing point.

4. An anti-ingestion system for a marine drive having an internal combustion engine, the system comprising:

an exhaust system discharging exhaust at an exhaust outlet below the surface of a body of water in which the marine drive is operating;

a cooling system drawing cooling water from the body of water and pumping the cooling water through a water conduit to an exhaust mixing point to discharge into and mix with exhaust from the exhaust system; and a duckbill valve being operated by differential pressure thereacross to a closed condition when the engine is operating in an on state and the cooling water is being pumped through the water conduit to the exhaust mixing point, the duckbill valve in the closed condition blocking passage of cooling water therepast, the duckbill valve being operated by differential pressure thereacross to an open condition when the engine is in an off state and the cooling water is not being pumped through the water conduit to the exhaust mixing point, the duckbill valve in the open condition permitting passage of air therethrough and communication of atmospheric pressure to the exhaust mixing point to relieve vacuum in the exhaust system;

wherein the duckbill valve is connected in communication with the water conduit and the duckbill valve in the open condition permits communication of atmospheric pressure to the exhaust mixing point to relieve vacuum in the exhaust system; and wherein the water conduit is connected at a connection point to an exhaust elbow water jacket to flow to the exhaust mixing point, the duckbill valve being in a side branch conduit extending from the water conduit; and the exhaust elbow water jacket having a lower segment passing the cooling water therethrough twin the water conduit.

5. An anti-ingestion system for a marine drive having an internal combustion engine, the system comprising:

an exhaust system discharging exhaust at an exhaust outlet below the surface of a body of water in which the marine drive is operating;

a cooling system drawing cooling water from the body of water and pumping the cooling water through a water conduit to an exhaust mixing point to discharge into and mix with exhaust from the exhaust system; and a duckbill valve being operated by differential pressure thereacross to a closed condition when the engine is operating in an on state and the cooling water is being pumped through the water conduit to the exhaust mixing point, the duckbill valve in the closed condition blocking passage of cooling water therepast, the duckbill valve being operated by differential pressure thereacross to an open condition when the engine is in an off state and the cooling water is not being pumped through the water conduit to the exhaust mixing point, the duckbill valve in the open condition permitting passage of air therethrough and communication of atmospheric pressure to the exhaust mixing point to relieve vacuum in the exhaust system; and wherein the duckbill valve is actuated into the open condition under sufficient differential pressure after turn-off of the engine and remains in the open condition until the differential pressure decreases to a point where the resiliency of the valve returns the valve to the dosed condition.

6. An anti-ingestion system for a marine drive having an internal combustion engine, the system comprising:

an exhaust system discharging exhaust at an exhaust outlet below the surface of a body of water in which the marine drive is operating;

a cooling system drawing cooling water from the body of water and pumping the cooling water through a water conduit to an exhaust mixing point to discharge into and mix with exhaust from the exhaust system; and a duckbill valve being operated by differential pressure thereacross to a closed condition when the engine is operating in an on state and the cooling water is being pumped through the water conduit to the exhaust mixing point, the duckbill valve in the closed condition blocking passage of cooling water therepast, the duckbill valve being operated by differential pressure thereacross to an open condition when the engine is in an off state and the cooling water is not being pumped through the water conduit to the exhaust mixing point, the duckbill valve in the open condition permitting passage of air therethrough and communication of atmospheric pressure to the exhaust mixing point to relieve vacuum in the exhaust system; and wherein:

the cooling system comprises a drain valve having an open state draining the cooling system of the cooling water including when the exhaust outlet is below the surface of the body of water; and the duckbill valve is in the open condition when the drain valve is in the open state, to relieve possible vacuum in the cooling system and facilitate the draining of the cooling water therefrom.

7. An anti-ingestion system according to claim 6, wherein the duckbill valve further communicates atmospheric pressure to the cooling system when the cooling system is drained of cooling water.

8. An anti-ingestion system for a marine drive having an internal combustion engine, the system comprising:

an exhaust system discharging exhaust at an exhaust outlet below the surface of a body of water in which the marine drive is operating;

a cooling system drawing cooling water from the body of water and pumping the cooling water through a water conduit to an exhaust mixing point to discharge into and mix with exhaust from the exhaust system; and a duckbill valve being operated by differential pressure thereacross to a closed condition when the engine is operating in an on state and the cooling water is being pumped through the water conduit to the exhaust mixing point, the duckbill valve in the closed condition blocking passage of cooling water therepast, the duckbill valve being operated by differential pressure thereacross to an open condition when the engine is in an off state and the cooling water is not being pumped through the water conduit to the exhaust mixing point, the duckbill valve in the open condition permitting passage of air therethrough and communication of atmospheric pressure to the exhaust mixing point to relieve vacuum in the exhaust system; and a cap on the duckbill valve, the cap being sealed against a flange extending from the duckbill valve.

9. An anti-ingestion system according to claim 8, wherein the cap comprises opposing apertures admitting air into the duckbill valve.

10. An anti-ingestion system for a marine drive having an internal combustion engine, the system comprising:

an exhaust system discharging exhaust at an exhaust outlet below the surface of a body of water in which the marine drive is operating;

a cooling system drawing cooling water from the body of water and pumping the cooling water through a water conduit to an exhaust mixing point to discharge into and mix with exhaust from the exhaust system; and a duckbill valve being operated by differential pressure thereacross to a closed condition when the engine is operating in an on state and the cooling water is being pumped through the water conduit to the exhaust mixing point, the duckbill valve in the closed condition blocking passage of cooling water therepast, the duckbill valve being operated by differential pressure thereacross to an open condition when the engine is in an off state and the cooling water is not being pumped through the water conduit to the exhaust mixing point, the duckbill valve in the open condition permitting passage of air therethrough and communication of atmospheric pressure to the exhaust mixing point to relieve vacuum in the exhaust system; and wherein the exhaust system comprises an exhaust elbow water jacket conveying cooling water to the exhaust mixing point when the engine is operating in the on state and wherein the duckbill valve is connected in communication with the exhaust elbow water jacket.

11. An anti-ingestion system according to claim 10, wherein the duckbill valve is directly connected to the exhaust elbow water jacket by a fitting.

12. An anti-ingestion system according to claim 11, wherein the duckbill valve comprises a first end exposed to atmosphere and a second end exposed to the exhaust elbow water jacket.

13. An anti-ingestion system according to claim 12, comprising a screen on the first end filtering air flow through the duckbill valve to the exhaust elbow water jacket.

14. An anti-ingestion system according to claim 13, comprising a screen on the second end filtering cooling water to keep debris out of the duckbill valve.

15. An anti-ingestion system according to claim 11, wherein the fitting is connected to the exhaust elbow via a threaded connection.

16. An anti-ingestion system according to claim 15, comprising a seal preventing air flow through the threaded connection.

* * * * *